US010542825B1

(12) United States Patent
Antinori et al.

(10) Patent No.: US 10,542,825 B1
(45) Date of Patent: Jan. 28, 2020

(54) MULTI-ZONE MATTRESS

(71) Applicants: Steven J. Antinori, Tampa, FL (US); Bill Frame, Valrico, FL (US); Jon Studner, Rockville, MD (US)

(72) Inventors: Steven J. Antinori, Tampa, FL (US); Bill Frame, Valrico, FL (US); Jon Studner, Rockville, MD (US)

(73) Assignee: PROTECH, LLC, Tampa, FL (US)

( * ) Notice: Subject to any disclaimer, the term of this patent is extended or adjusted under 35 U.S.C. 154(b) by 336 days.

(21) Appl. No.: 15/731,633

(22) Filed: Jul. 12, 2017

(51) Int. Cl.

| | |
|---|---|
| ***A47C 27/15*** | (2006.01) |
| ***A47C 27/20*** | (2006.01) |
| ***A47C 27/14*** | (2006.01) |
| ***A47C 27/06*** | (2006.01) |
| ***A47C 31/12*** | (2006.01) |
| ***A47C 31/02*** | (2006.01) |

(52) U.S. Cl.
CPC ..... *A47C 27/15* (2013.01); *A47C 27/065* (2013.01); *A47C 27/142* (2013.01); *A47C 27/148* (2013.01); *A47C 27/20* (2013.01); *A47C 31/02* (2013.01); *A47C 31/123* (2013.01)

(58) Field of Classification Search
CPC ..... A47C 27/15; A47C 27/065; A47C 27/142; A47C 27/148; A47C 27/20; A47C 27/061; A47C 27/062; A47C 31/02; A47C 31/123
See application file for complete search history.

(56) References Cited

U.S. PATENT DOCUMENTS

| | | | | |
|---|---|---|---|---|
| 3,146,469 | A * | 9/1964 | Slade | A47C 27/144 5/695 |
| 4,213,214 | A * | 7/1980 | Gilhooly | A47C 27/001 5/679 |
| 5,134,735 | A * | 8/1992 | Rose | A47C 27/146 5/730 |
| 5,604,021 | A * | 2/1997 | Wagner | A47C 27/146 428/158 |
| 5,960,496 | A * | 10/1999 | Boyd | A47C 27/144 5/722 |
| 7,036,172 | B2 * | 5/2006 | Torbet | A47C 27/082 5/713 |
| 7,240,386 | B1 * | 7/2007 | McKay | A47C 21/044 5/423 |
| 7,386,903 | B2 * | 6/2008 | Hochschild | A47C 27/001 5/691 |
| 7,748,066 | B2 * | 7/2010 | Gladney | A47C 27/061 5/710 |
| 7,841,031 | B2 * | 11/2010 | Rawls-Meehan | A47C 7/027 5/719 |

(Continued)

*Primary Examiner* — Nicholas F Polito
*Assistant Examiner* — Rahib T Zaman
(74) *Attorney, Agent, or Firm* — Arthur W. Fisher, III

(57) ABSTRACT

A multi-zone mattress comprising a top layer, an intermediate layer and a bottom layer disposed in substantially parallel relationship relative to each other including a first plurality of zones each having a first firmness profile to support a person thereon separated by a second plurality of zones each having a second firmness profile less than the firmness of the first firmness profile of the first plurality of zones, the first plurality of zones and the second plurality of zones each cooperatively formed by corresponding sections of the top layer, intermediate layer and bottom layer disposed in substantially parallel alignment relative to each other.

24 Claims, 12 Drawing Sheets

(56) References Cited

U.S. PATENT DOCUMENTS

| | | | | |
|---|---|---|---|---|
| 8,997,279 | B1 * | 4/2015 | McKay | A47C 23/002 5/423 |
| 9,289,074 | B1 * | 3/2016 | Corbin | A47C 27/15 |
| 9,867,475 | B2 * | 1/2018 | Kulju | A47C 27/05 |
| 2004/0237203 | A1 * | 12/2004 | Romano | A47C 27/122 5/713 |
| 2007/0017033 | A1 * | 1/2007 | Antinori | A47C 23/0522 5/716 |
| 2007/0157394 | A1 * | 7/2007 | Giggleman | A47C 27/144 5/727 |
| 2007/0289069 | A1 * | 12/2007 | Wells | A47C 27/056 5/727 |
| 2008/0072382 | A1 * | 3/2008 | James | A47C 27/04 5/717 |
| 2008/0201856 | A1 * | 8/2008 | Howard | A47C 27/001 5/690 |
| 2010/0058541 | A1 * | 3/2010 | Kemper | A47C 27/001 5/701 |
| 2010/0146706 | A1 * | 6/2010 | Siegner | A61G 1/04 5/626 |
| 2011/0010249 | A1 * | 1/2011 | Oexman | A47C 31/123 705/14.66 |
| 2012/0124753 | A1 * | 5/2012 | Lee | A47C 27/144 5/727 |
| 2016/0278538 | A1 * | 9/2016 | Nassif | A47D 15/001 |

* cited by examiner

MULTI-ZONE MATTRESS

BACKGROUND OF THE INVENTION

Field of the Invention

A multi-zone mattress comprising a first plurality of zones and a second plurality of zones having different firmness profiles to support a person thereon.

Description of the Prior Art

Mattresses generally comprise three components: an innerspring support system, comfort layers and exterior fabric covering. Some mattresses may also include box springs. The innerspring support system is constructed from a series of wire coils or springs. There are four different types of springs used in mattresses: Bonnell, offset, continuous, and pocket system. Generally, the springs are attached to each other by wire. However, a pocket spring system comprises a plurality of small or micro-springs each disposed with a separate pocket formed by an upper and lower fabric. An insulator is secured directly to the innerspring such as inflexible wire mesh and foam. The insulator prevents the cushioning layer from molding to the springs. The cushioning layer is applied next and is comprised of different densities of foam, polyester and other natural fibers such as cotton pads. The number of cushioning layers applied depends on the quality of the mattress. The top comfort layer, called the quilt, may be constructed of light foam or fibers attached to the ticking. The ticking is the cover that is applied to the mattress. This and the quilted top layer of the mattress are sewn. This material is cut into the covering for the top, bottom and sides of the mattress and flanges are attached to the sides with fabric staples or to the innersprings by hog rings. These flanges are used to connect the mattress cover to the innersprings. Once this is done the mattress ticking is sewn together using border tape. This is fed through a specially designed machine that sews the material closed and gives the mattress its final finish.

Examples of the prior art are discussed below.

U.S. Pat. No. 6,964,074 discloses a sleep set and process of forming thereof comprises a mattress and box spring each having an allergen-impermeable barrier layer incorporated within. The mattress comprises a support apparatus, a top and bottom panel, first and second flanges, a border, a foam layer and a barrier layer. The border is positioned around the support apparatus and is attached to the top and bottom panels. The foam layer is positioned between the support apparatus and the top and bottom panels. The barrier layer comprises a material configured to be impermeable by allergens attached at its outer periphery to the interior facing sides of the top panel, the bottom panel and the border.

U.S. Pat. No. 7,917,980 relates to a mattress embodying a foam encasement surrounding individually wrapped coils. Border material is affixed to sidewalls forming the foam encasement and the upholstery layer is tacked to a base of the foam encasement.

U.S. Pat. No. 2,975,437 shows a pad wider than the wider frame the sisal pad. The over lapped end portion are joined together by the staples. The staples pass through the top part of the sisal pad and wire frame and the bottom part of sisal pad.

U.S. Pat. No. 6,944,900 discloses a mattress having an inverted top panel/border seam. An inverted seam secures the top panel to the border portion of a mattress cover to eliminate bumps and creases found in conventional welted top seam. Alternatively, a conventional tape edge machine can be used with reduced tape/welting material as all the stitches and welting are hidden inside the mattress by the inverted seam.

U.S. Pat. No. 6,398,199 relates to a coil spring assembly comprising rows of pocketed coil springs, a top securing sheet and a bottom securing sheet. The assembly may be partitioned into sections of varying firmness. The rows of coil springs are positioned between the top and bottom securing sheets.

U.S. Pat. No. 5,586,511 shows an improved method and apparatus for the assembly of pillow-top mattress covers. The gussets for a pillow-top mattress cover are prepared in a single step in which the gusset material is folded longitudinally, and the flange material is attached thereto and the gusset material is sewn together in one stitch. Thereafter, a gusset is attached to each of the top and bottom panels of the cover along its outer edge. Each gusset is secured to the underside of its associated top or bottom panel at the folded edge using a blind stitch which is not visible externally of the panel. No gluing is required. During the step of attaching the gusset to its associated mattress cover panel, precisely positioned mitered corners are formed on the gusset where the gusset is to be attached to the corner of its associated panel. A conventional blind stitch machine is modified to accept thicker work by providing a wider cam for urging work into the needle area, top and bottom feed rollers disposed even with the needle, and pneumatic control of the lower support arm.

U.S. Pat. No. 6,574,815 relates to an attachment gusset with ruffled corners and method and machinery for manufacture provides a gusset formed of a continuous strip of material which is pleated at corners or turns in direction of the gusset to form ruffles which are attached to an adjacent layer of material. The ruffled gusset lies substantially flat against adjacent layers of material to which it is attached in a pressed state, and can be expanded to accommodate dimensional structures, such as cushioned pads. The number and spacing of pleats can be adjusted according to the radius of the corners or turns in the gusset. In a method of construction of the gusset, the pleats are formed as the material to which the gusset is attached is turned relative to the sewing point of attachment.

U.S. Pat. No. 2,399,628 shows a rubber pad from one to two inches in thickness and both wider and longer than the spring unit so that when assembled with the spring unit overhanging the marginal wires on all sides by about one inch. The pad is protected by a cloth casing to which it should be secured immovably without interference with flexing of the pad and to this end a heavy cotton duck or other porous cloth sheet is stretched over the top of the pad while a similar or even heavier fabric sheet is stretched over the bottom of the pad with both sheets being stitched to together.

U.S. Pat. No. 2,587,112 relates to a covering pad of sisal extending over the upper ends of the springs. This pad is folded at its longitudinal edges to extend about the top rectangular spring frame to which the upper ends of the springs are connected. The rectangular frame extends about the periphery frame of the spring structure and acts as a means of connecting the various springs and holding them in proper relation. The edge of the sisal pad is wrapped about the frame member to provide a folded edge underlying a portion of the sisal pad inwardly of the spring frame. Staples or other suitable fastening means extend through the body of the pad to hold the edge folded about the spring frame.

U.S. Pat. No. 4,075,721 discloses a mattress construction and method in which an extremely wide, deep stitch flange permits a more uniform and tighter mattress construction. A mattress cover is sewn to an apron or flanging material with a wide border or flange with the thread being deeply set in the cover by the thick foam padding between the flange material and the cover. This construction allows the apron to be very tightly pulled over a coil spring and stapled through sisal padding to the coil spring rim or border. The stretching of the flange skirt and cover creates a bow in the coil spring pulling the rim toward the center. The wide flange then permits the skirt or side cover to be tightly stitched with edging tape or binding material to produce a very firm and flat mattress construction.

U.S. Pat. No. 5,461,737 shows a pad arranged on the upper and lower sides of a spring unit to provide a laminate structure. The laminate structure is covered with an outer cover body comprising top and bottom layers covering the corresponding pads and a side layer covering the laminate structure. A joining member of heat-shrinkable synthetic resin has one end width portion joined to the inner surfaces of the whole marginal edge portions of the top and bottom layers. The other end width portion of the joining member covers the corresponding outer marginal edge portions of the pads. The joining member, upon being heat shrunk, have another end width portion brought into firm engagement with the spring unit so that the pads and outer cover body are firmly held relative to the spring unit.

US 2014/0096325 depicts a mattress having a first and second support surface configured to support a user where each support surface has a different level of firmness.

JP 2009131645 shows a dual sided mattress with different firmness levels. An array of first coil springs comprising a first coil spring layer and an array of the second coil springs comprising a second coil spring layer to create a dual firmness.

US 2013/0081209 also discloses a dual sided mattress with different degrees of firmness.

U.S. Pat. No. 7,992,242 relates to a mattress including a head, torso and leg firmness zone.

US 2016/0029811 discloses a foam spring mattress including a plurality of foam springs forming patterns of varied firmnesses.

U.S. Pat. No. 6,353,952 describes a bedding product including a plurality of coil springs arranged in rows and columns divided into sections. The springs of one section are taller than the springs of another section. Filler is placed above the shorter springs in select sections. The taller springs are of a greater firmness than the filler material thus creating a posturized effect.

U.S. Pat. No. 6,813,791 shows a bedding product comprising a pocket spring assembly including a plurality of parallel rows or columns of springs joined to each other. Each of the rows or columns of springs comprises a plurality of interconnected pocket coil springs. The product has multiple sections of differing firmness attributable in part to differing heights of the pockets of the strings of springs. Filler is placed above the lower sections of the pocketed spring assembly.

US 2011/0191962 relates to a mattress including spring assembly comprising a plurality of first and second section of coils arranged in rows. The first section of coils are different in size from the second section of coils defining a plurality of zones of different firmness.

US 2002/0195756 depicts a spring coil assembly having a first row of coils arranged in a first spacing pattern and a second row of coils in a second spacing pattern creating areas of different firmness.

GB 2,215,199 describes a multiple zone mattress with different spacing of the support elements to vary the firmness of the different zones.

U.S. Pat. No. 6,295,676 shows a mattress with staggered rows of pocket springs disposed about the periphery of the interior supporting pocket springs.

U.S. Pat. No. 7,886,385 relates to a mattress including quilted zone panels with stitching of different spacing to produce zones of different firmness.

DE 3,321,720 depicts a padded foam support constructed of interlocking sections of foam material with different degrees of hardness.

U.S. Pat. No. 4,053,957 shows a multi-layered mattress including an upper and lower layer. The resiliency of the material in the upper layer is greater than that of the lower layer which when interlocked to create different zones of firmness.

Additional examples of the prior art are found in the following documents: U.S. Pat. Nos. 7,412,036; 6,874,214; 3,068,495; 2,887,693; 2,627,902; 2,621,713; 2,615,504; 2,560,018; 2,359,047; 2,134,363; 1,781,086; 1,557,483; 1,336,525; 1,323,370; 1,291,773; 0,884,708; 0,854,161; 4,476,595; 1,387,744; 2,049,551; 2,681,457; 3,083,380; 3,319,274; 3,769,643; 3,999,234; 4,862,540; 5,105,488; 5,231,717; 6,658,682; 7,574,762; 7,617,556; 8,176,589; 8,209,804; 8,341,786; 8,448,315; 8,832,889; 9,332,856; 9,380,883; US 2008/184492; US 2012/0180225; US 2016/0015185; US 2016/0157626; DE 3,236,714; EP 0,180,244; EP 1,364,602 and JP 2009-131,645.

While portions of the prior art may contain some similarities relating to separate aspects of the present invention; none teaches, suggests or includes all of the advantages and unique features of the invention disclosed hereafter.

SUMMARY OF THE INVENTION

The present invention relates to a multi-zone mattress comprising a plurality of first zones each having a first firmness profile to support a person thereon separated by a plurality of second zones each having a second firmness profile less than the firmness of the first firmness profile of the plurality of first zones wherein each of the plurality of first zones and the plurality of second zones each comprises multiple sections of different firmness as to cooperatively form the plurality of first discrete zones and the plurality of second discrete zones.

More specifically, the multi-zone mattress comprises a top layer, an intermediate layer and a bottom layer assembled together to form the multi-zone mattress.

The top layer comprises an outer panel and an inner backing having a panel of resilient material such as foam disposed therebetween. The outer panel comprises a first plurality of sections including a proximal section, a middle section and a distal section separated by a second plurality of sections including a pair of intermediate sections. The first plurality of sections has a first firmness profile to support a person thereon and the second plurality of sections has a second firmness profile less than the firmness of the first plurality of sections.

The intermediate layer comprises an intermediate block of resilient material comprising a first plurality of sections including a proximal section, a middle section and a distal section separated by a second plurality of sections including a pair of intermediate sections. The first plurality of sections has a first firmness profile to support a person thereon and the second plurality of sections has a second firmness profile less than the firmness of the first plurality of sections.

The bottom layer comprises a resilient base comprising a first plurality of sections including a proximal section, a middle section and a distal section separated by a second plurality of sections including a pair of intermediate sections. The first plurality of sections has a first firmness profile to support a person thereon and the second plurality of sections has a second firmness profile less than the firmness of the first plurality of sections.

Corresponding proximal sections cooperatively form a proximal support zone, corresponding middle sections cooperatively form a middle support zone and corresponding distal sections cooperatively form a distal support zone to form the first plurality of zones having a first firmness profile to support a person thereon.

Similarly, corresponding intermediate sections together cooperatively form corresponding interior zones to form the second plurality of zones having a second firmness profile less than the firmness of the first plurality of zones.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

The present invention relates to a multi-zone mattress comprising a plurality of first zones each having a first firmness profile to support a person thereon separated by a plurality of second zones each having a second firmness profile less than the firmness of the first firmness profile of the plurality of first zones wherein each of the plurality of first zones and each of the plurality of second zones each comprises multiple sections of different firmnesses to cooperatively form the plurality of first zones and the plurality of second zones.

Figure 1:
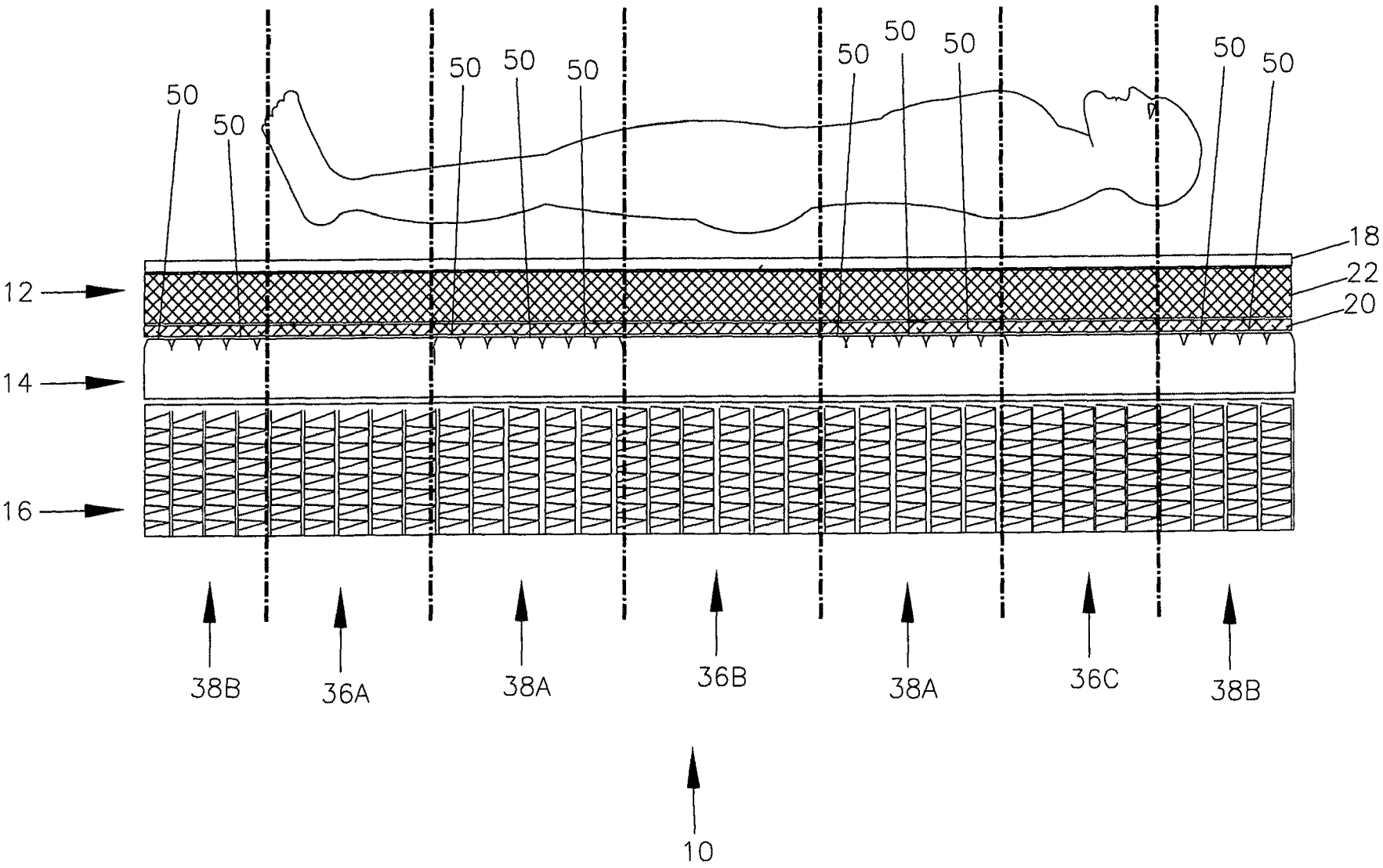
FIG. 1 is a cross-sectional side view of the multi-zone mattress of the present invention.
Figure 2:
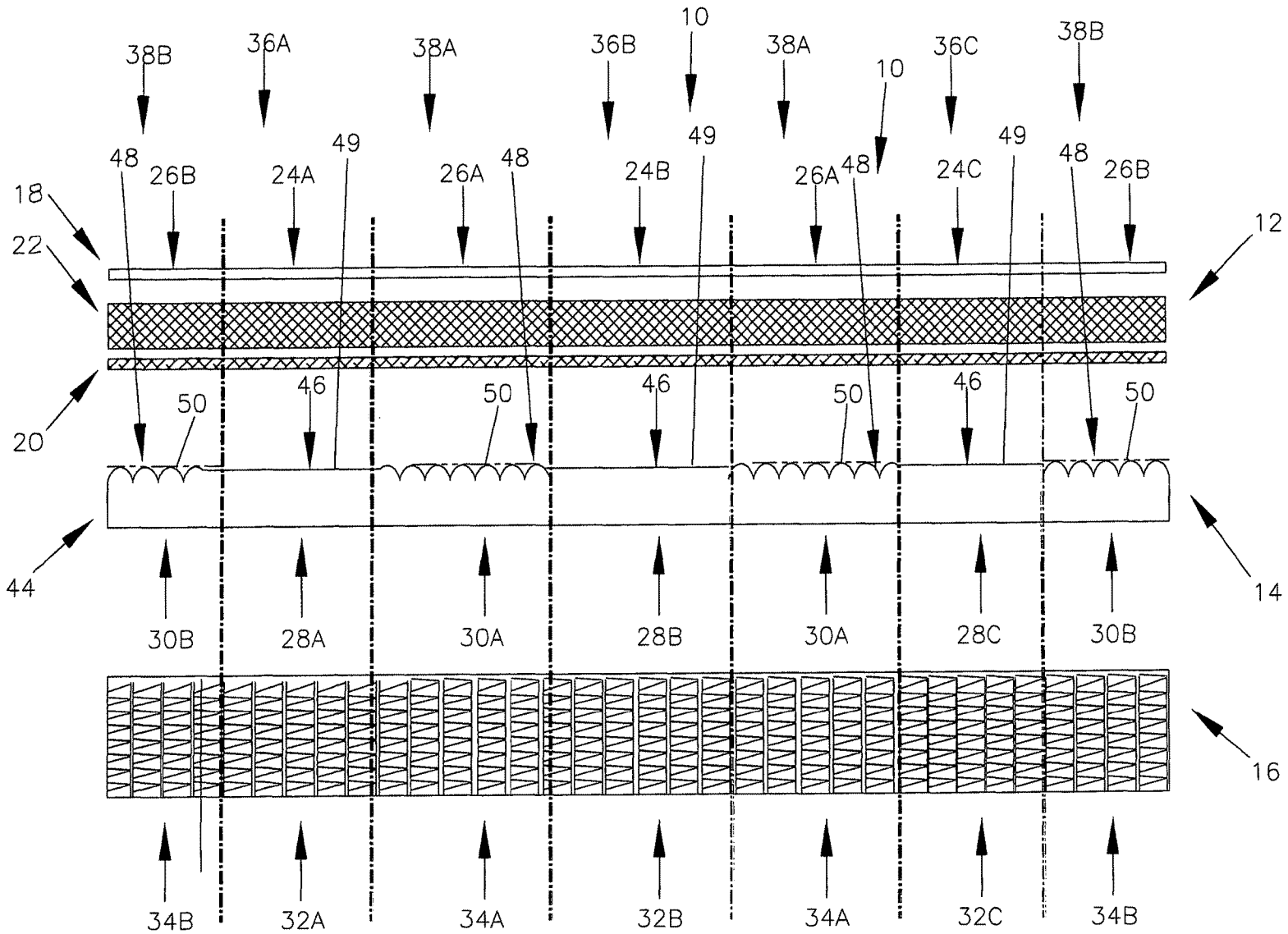
FIG. 2 is an exploded cross-sectional side view of the multi-zone mattress of the present invention.

As shown in FIGS. 1 and 2, the multi-zone mattress generally indicated as 10 comprises a top layer generally indicated as 12, an intermediate layer generally indicated as 14 and a bottom layer generally indicated as 16 assembled together to form the multi-zone mattress 10.

As shown in FIGS. 1 and 2, the top layer 12 comprises a quilted or outer upholstery panel generally indicated as 18 and an inner fabric backing generally indicated as 20 having a panel or block of resilient material generally indicated as 22 such as foam disposed therebetween. The top layer 14 comprises a first plurality of sections including a proximal section generally indicated as 24A, a middle section generally indicated as 24B and a distal section generally indicated as 24C separated by a second plurality of sections including a pair of interior sections each generally indicated as 26A. The first plurality of sections comprising sections 24A, 24B and 24C has a first firmness profile to support a person thereon and the second plurality of sections 26A has a second firmness profile less than the first firmness profile of the first plurality of sections 24A, 24B and 24C. In addition, the second plurality of sections may further comprise a pair of exterior sections each generally indicated as 26B formed or disposed on each end portion of the top layer 12 of the multi-zone mattress 10.

As shown in FIGS. 1 and 2, the intermediate layer 14 comprises an intermediate block of resilient material such as foam comprising a first plurality of sections including a proximal section generally indicated as 28A, a middle section generally indicated as 28B and a distal section generally indicated as 28C separated by a second plurality of sections including a pair of interior sections each generally indicated as 30A. The first plurality of sections comprising sections 28A, 28B and 28C has a first firmness profile to support a person thereon and the second plurality of sections 30A has a second firmness profile less than the first firmness profile of the first plurality of sections 28A, 28B and 28C. In addition, the second plurality of sections may further comprise a pair of exterior sections each generally indicated as 30B formed or disposed on each end portion of the intermediate layer 14 of the multi-zone mattress 10.

As shown in FIGS. 1 and 2, the bottom layer 16 comprises a resilient base such as a plurality of coil springs arranged or disposed in rows and columns comprising a first plurality of sections including a proximal section generally indicated as 32A, a middle section generally indicated as 32B and a distal section generally indicated as 32C separated by a second plurality of sections including a pair of interior sections each generally indicated as 34A. The first plurality of sections comprising sections 32A, 32B and 32C has a first firmness profile to support a person thereon and the second plurality of sections 34A has a second firmness profile less than the first firmness profile of the first plurality of sections 32A, 32B and 32C. In addition, the second plurality of sections may further comprise a pair of exterior sections each generally indicated as 34B formed on each end portion of the bottom base layer 16 of the multi-zone mattress 10.

As shown in FIGS. 1 and 2, the proximal section 24A of the top layer 12, the proximal section 28A of the intermediate layer 14 and the proximal section 32A of the bottom layer 16 cooperatively form a proximal support zone generally indicated as 36A; the middle section 24B of the top layer 12, the middle section 28B of the intermediate layer 14 and the middle section 32B of the bottom layer 16 cooperatively form a middle support zone generally indicated as 36B; and the distal section 24C of the top layer 14, the distal section 28C of the intermediate layer 14 and the distal section 32C of the bottom layer 16 cooperatively form a distal support zone generally indicated as 36C to form the first plurality of zones having a first firmness profile to support a person on the multi-zone mattress 10.

Similarly as shown in FIGS. 1 and 2, corresponding interior sections 26A of the top layer 12, interior sections 30A of the intermediate layer 14 and the interior sections 34A of the bottom layer 16 cooperatively form interior zones each generally indicated as 38A; while, corresponding exterior sections 26B of the top layer 12, exterior sections 30B of the intermediate layer 14 and the exterior sections 34B of the bottom layer 16 cooperatively form exterior zones generally indicated as 38B to form the second plurality of zones having a second firmness profile.

Figure 3:
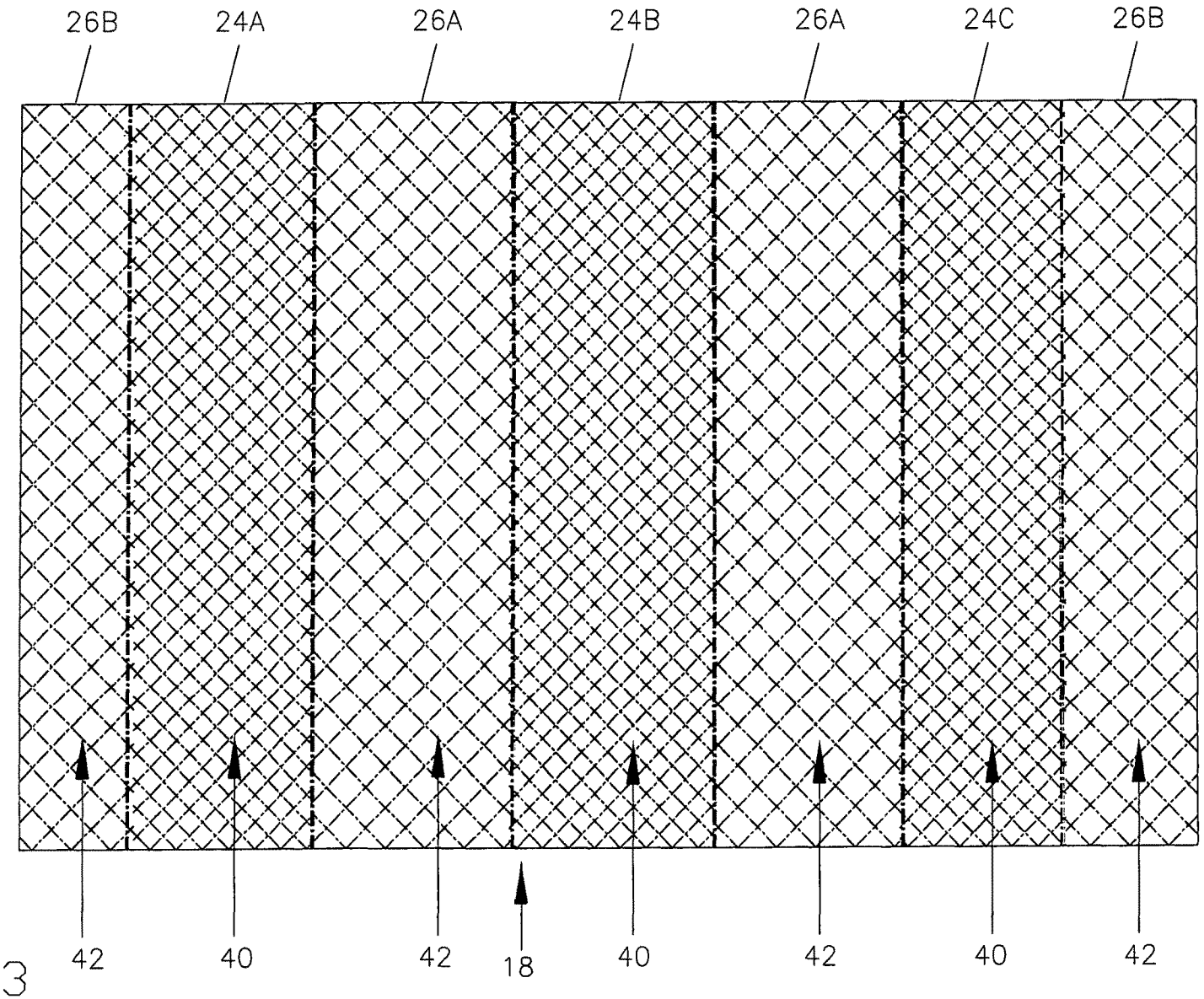
FIG. 3 is a top view of the top layer of the multi-zone mattress of the present invention.

FIG. 3 is a top view of the quilted or outer upholstery panel 18 of the top layer 12 of the multi-zone mattress 10. As depicted, the proximal section 24A, middle section 24B and distal section 24C of the quilted or outer upholstery panel 18 of the top layer 12 each includes a first pattern of stitching generally indicated as 40 denser than a second pattern of stitching generally indicated as 42 on the interior sections 26A and the exterior sections 26B such that the first plurality of sections 24A, 24B and 24C has the first firmness profile to support a person thereon and the second plurality of sections 26A and 26B has the second firmness profile less than the first firmness profile of the first plurality of sections 24A, 24B and 24C.

Figure 4:
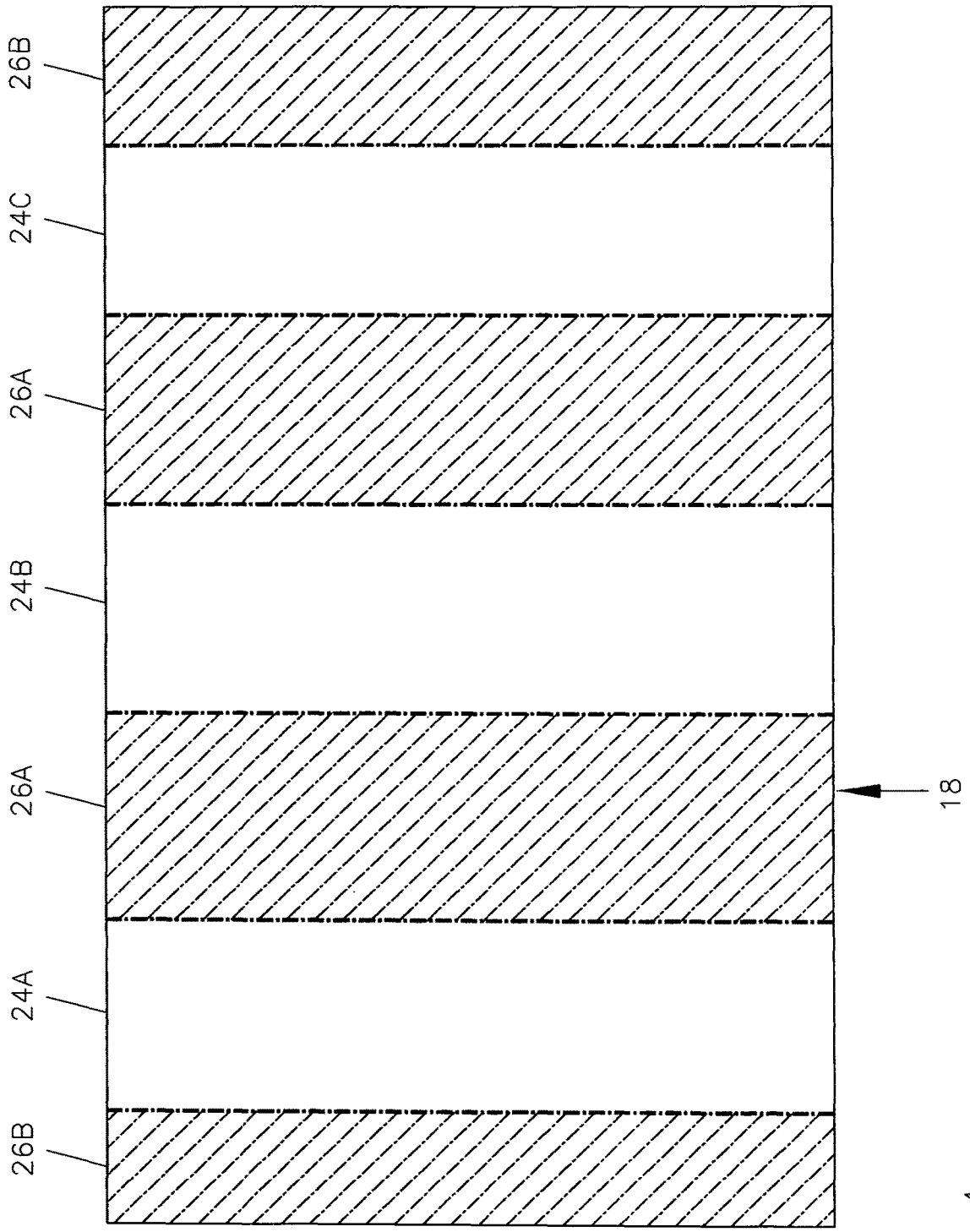
FIG. 4 is a top view of an alternate embodiment of the top layer of the multi-zone mattress of the invention.

FIG. 4 discloses an alternate embodiment of the quilted panel or outer upholstery panel 18 of the top layer 12 of the multi-zone mattress 10. Specifically, the proximal section 24A, middle section 24B and distal section 24C of the top layer 12 each comprises a separate panel of fabric having a weight or density greater than the weight or density of the separate panels forming the interior sections 26A and exterior sections 26B such that sections 24A, 24B, and 24C have a firmness profile greater than sections 26A and 26B to support a person thereon. Of course, the quilted panel or upholstery panel 18 of the top layer 12 may comprise a single sheet of fabric having a second sheet of fabric sewn or otherwise held in place on the single sheet of fabric to form sections 24A, 24B and 24C thicker than the single sheet of fabric such that sections 24A, 24B and 24C have a first firmness profile greater than the second firmness profile of sections 26A and 26B.

The proximal section 24A, middle section 24B and distal section 24C may be a tighter weave than the weave of the interior sections 26A and 26B.

Figure 5:
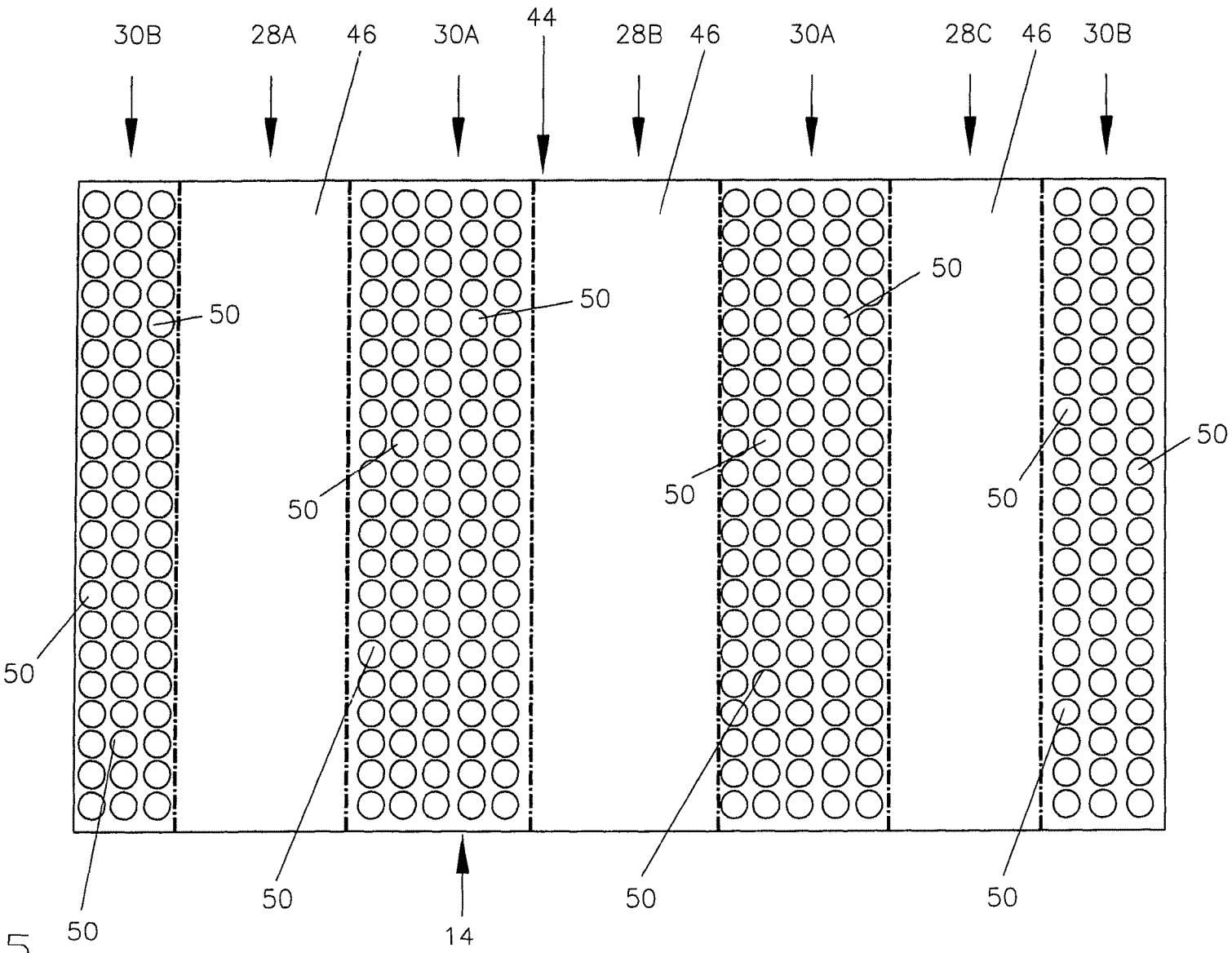
FIG. 5 is a top view of the intermediate layer of the multi-zone mattress of the present invention.

As shown in FIGS. 2 and 5, the intermediate layer 14 of the multi-zone mattress 10 comprises a block of resilient material generally indicated as 44 such as foam. The substantially flat upper surfaces 49 of sections 28A, 28B and 28C each indicated as 46, and the upper surfaces of sections 30A and 30B each indicated as 48 are disposed in substantially the same horizontal plane. A plurality of substantially convex resilient projections each indicated as 50 extends upwardly from the upper portions of the interior sections 30A and the exterior sections 30B of the intermediate layer 14. As shown in FIG. 2, the resilient projections 50 may comprise a configuration similar to an egg carton. As shown in FIG. 1, the plurality of resilient projections 50 are depressed or flattened under the weight of a person on the multi-zone mattress 10.

Figure 6:
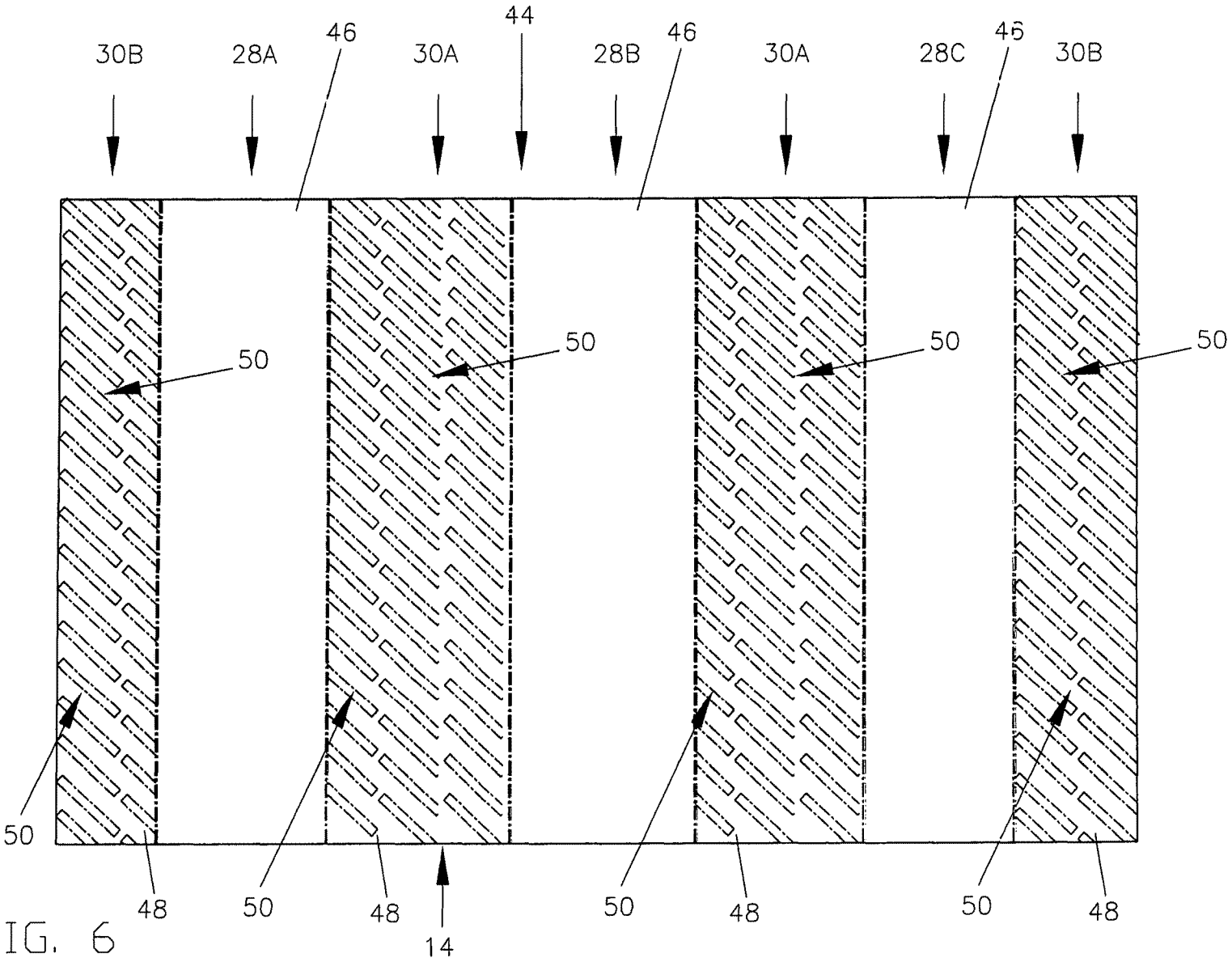
FIG. 6 is a top view of an alternate embodiment of the intermediate layer of the multi-zone mattress of the present invention.

FIG. 6 shows an alternate embodiment of the intermediate layer 14 of the multi-zone mattress. In particular, the intermediate layer 14 of the multi-zone mattress 10 comprises a block generally indicated as 44 of resilient material such as foam. The upper surfaces 46 of sections 28A, 28B and 28C and the upper surfaces 48 of sections 30A and 30B are disposed in substantially the same plane. A plurality of recesses each indicated as 50 are formed in the upper portions of the interior sections 30A and the exterior sections 30B of the intermediate layer 14. The plurality of grooves or recesses 50 are depressed or flattened under the weight of a person on the multi-zone mattress 10.

Figure 7:
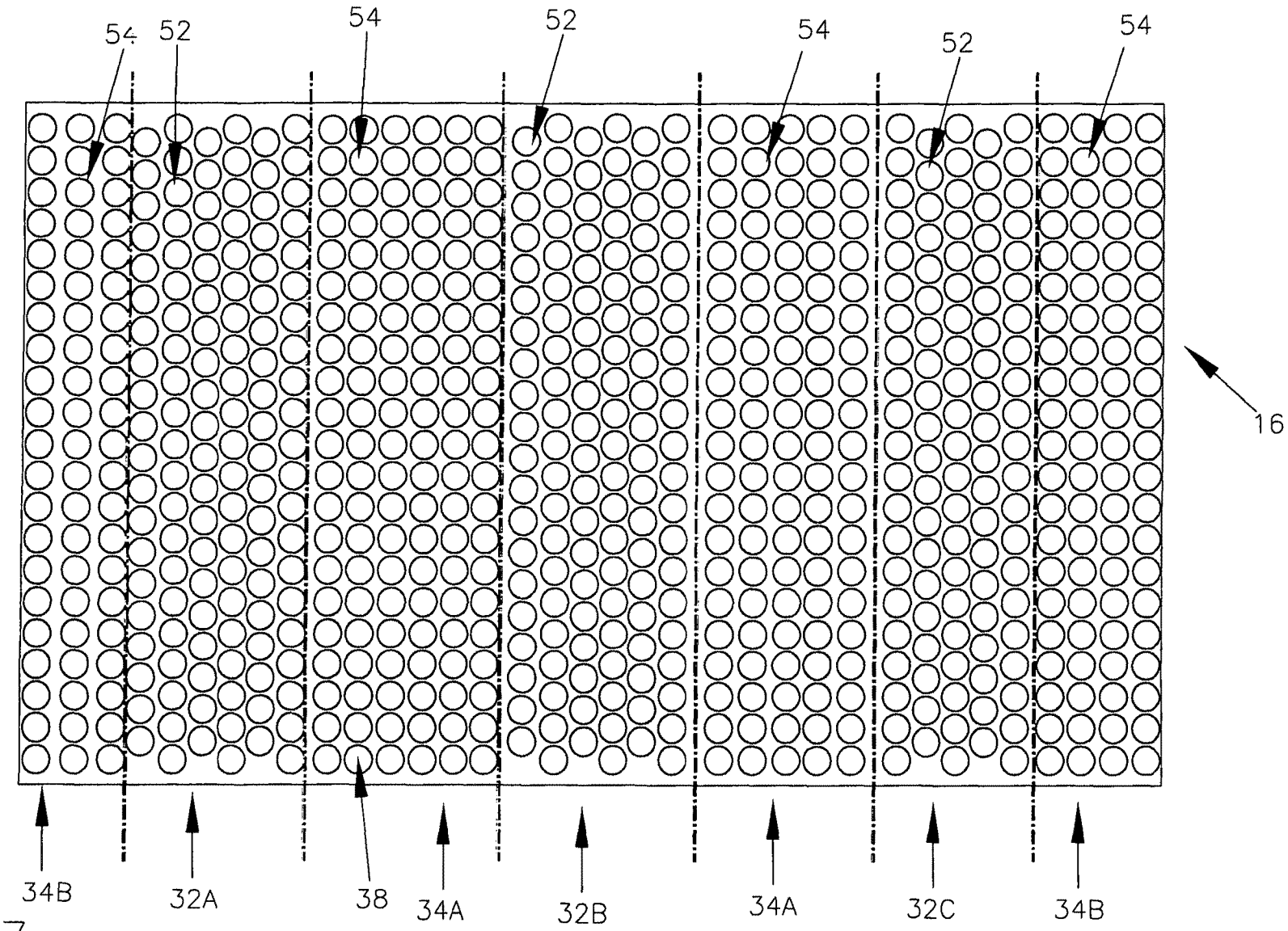
FIG. 7 is a top view of the bottom layer of the multi-zone mattress of the present invention.

FIG. 7 is a top view of the bottom layer 16 of the multi-zone mattress 10. Specifically, the bottom layer 16 comprises a plurality of coil springs arranged in rows and columns. The coil springs of the proximal section 32A, middle section 32B and 32C of the bottom layer 16 generally indicated as 52 disposed in adjacent rows are off-set to form a nested configuration; while, the plurality of coil springs of the interior sections 34A and exterior sections 34B of the bottom layer 16 are symmetrically arranged in rows and columns generally indicated as 54. Such nested configurations are firmer than the symmetrical non-nested configurations to provide more support than the symmetrical non-nested configurations.

Figure 8:
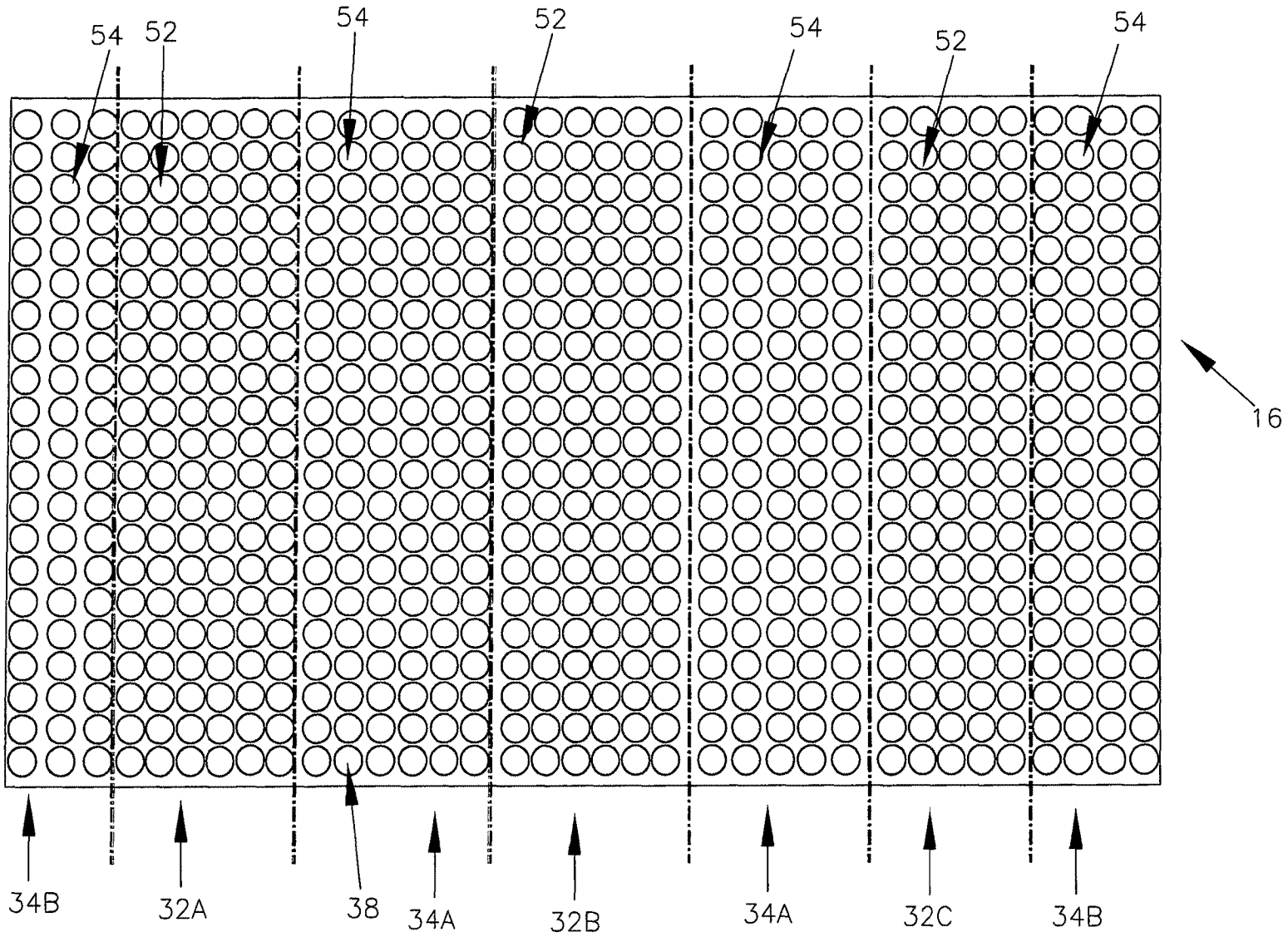
FIG. 8 is a top view of an alternate embodiment of the bottom layer of the multi-zone mattress of the present invention.

FIG. 8 depicts a top view of an alternate embodiment of the bottom layer 16 of the multi-zone mattress 10 comprising a plurality of coil springs. The symmetrically arranged or configured coil springs of the proximal section 32A, middle section 32B and distal section 32C generally indicated as 52 are less resilient or stiffer than the symmetrically arranged or configured coil springs of the interior sections 34A and the exterior sections 34B. The differences in resilience or stiffness is the coil springs 52 of the proximal section 32A, middle section 32B and distal section 32C and the coil springs 54 of the interior sections 34A and exterior sections 34B are due to differences in thickness or gauge of the coils, tempering of the coils or material of the coils as well as other factors generally known in the art.

Figure 9:
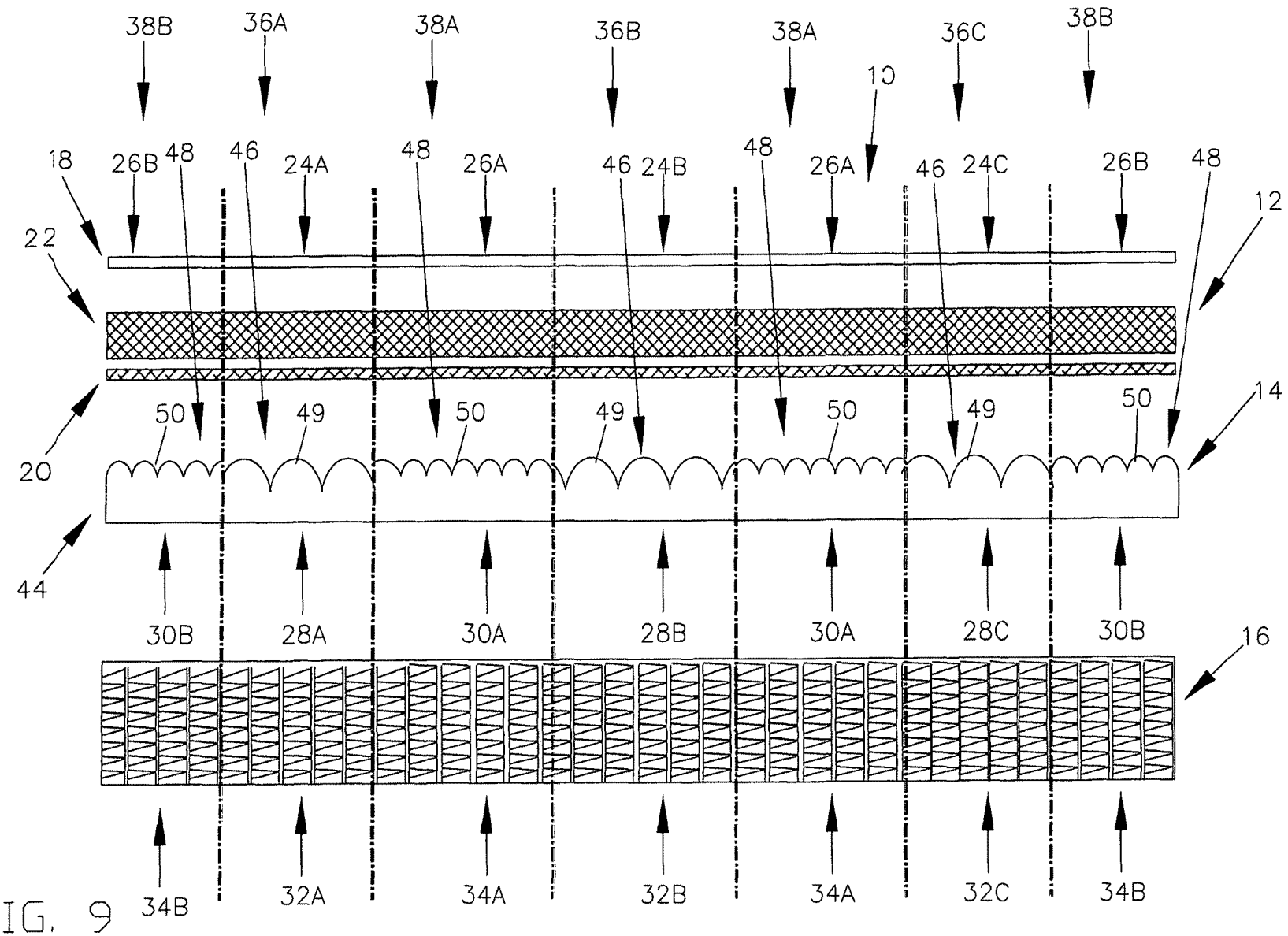
FIG. 9 is an exploded cross-sectional side view of an alternate embodiment of the multi-zone mattress of the present invention.

Except for the intermediate layer 14, FIG. 9 shows an alternate embodiment of the multi-zone mattress 10 virtually the same as the multi-zone mattress 10 of FIGS. 1 and 2. As such, corresponding structural elements are similarly designated. As depicted, the intermediate layer 14 of the multi-zone mattress 10 comprises a block generally indicated as 44 of resilient material such as foam. The upper surfaces of sections 28A, 28B and 28C each generally indicated as 46 and the upper surfaces of sections 30A and 30B each generally indicated as 48 are disposed in substantially the same horizontal plane. A plurality of substantially convex resilient projections each indicated as 49 extends upwardly from the upper portions of sections 28A, 28B and 28C of the intermediate layer 14. Similarly, a plurality of substantially convex resilient projections each indicated as 50 extends upwardly from the upper portions of the interior sections 30A and exterior sections 30B of the intermediate layer 14. Projections 49 are larger than projections 50. In addition, projections 50 may be disposed in spaced relationship relative to each other. Thus, in the aggregate, the upper surfaces of the substantially convex resilient projections 49 for each section 28A, 28B and 28C are greater than the upper surfaces of the substantially convex resilient projections 50 for each section 30A and 30B. Thus sections 28A, 28B and 28C are firmer or less resilient than sections 30A and 30B.

Figure 10:
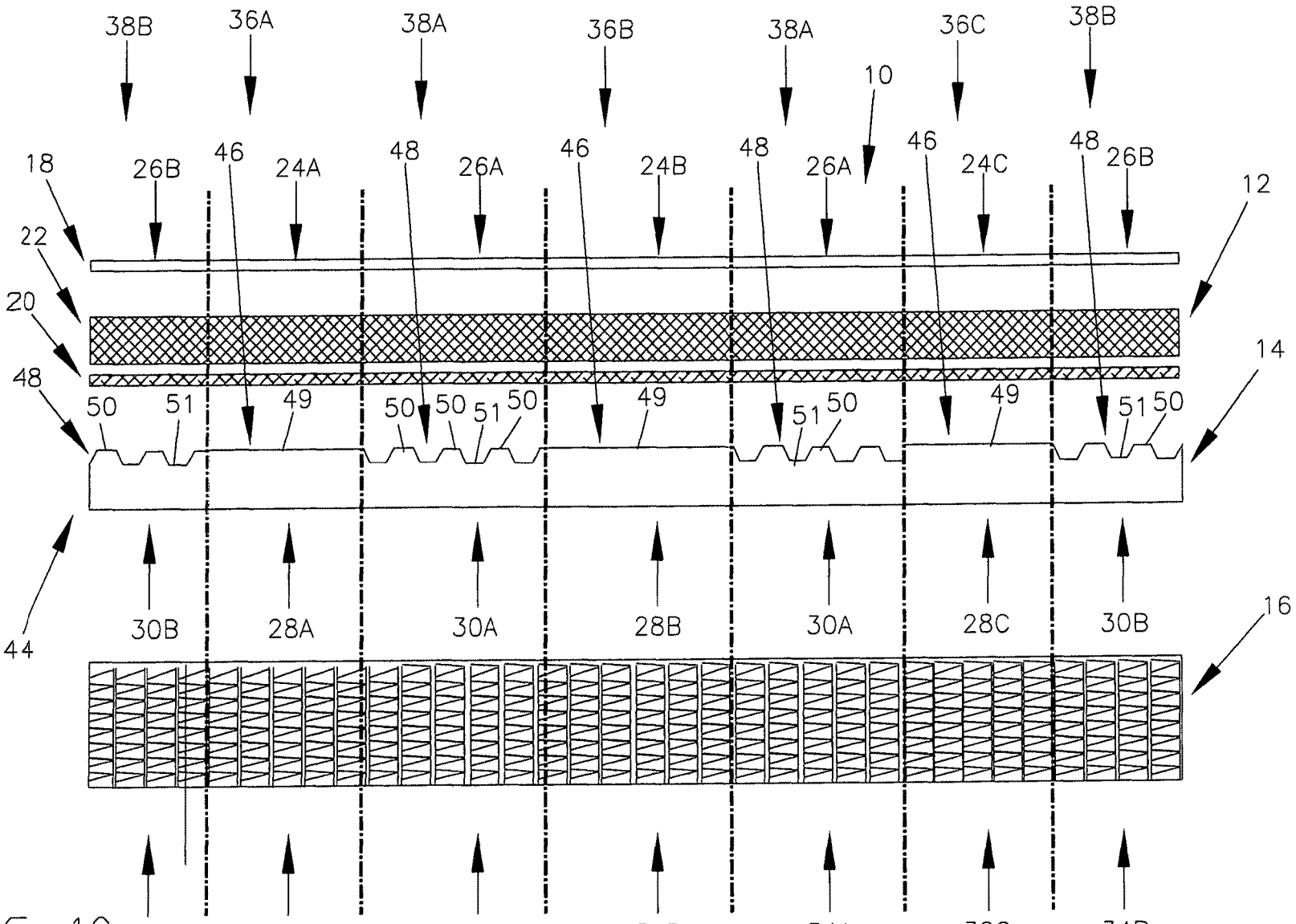
FIG. 10 is an exploded cross-sectional side view of another alternate embodiment of the multi-zone mattress of the present invention.

Except for the intermediate layer 14, FIG. 10 shows another alternate embodiment of the multi-zone mattress 10 virtually the same as the multi-zone mattress 10 of FIGS. 1 and 2. As such, corresponding structural elements are similarly designated. As depicted, the intermediate layer 14 of the multi-layer mattress 10 comprises a block generally indicated as 44 of resilient material such as foam. The upper surfaces of sections 28A, 28B and 28C each generally indicated as 46 and the upper surfaces of sections 30A and 30B each generally indicated as 48 are disposed in substantially the same horizontal plane. The upper surfaces 49 of sections 28A, 28B and 28C of the intermediate layer 14 are substantially flat. A plurality of resilient projections each indicated as 50 extends upwardly from the upper portions of the interior sections 30A and exterior sections 30B of the intermediate layer 14. Each resilient projection 50 of each section 30A and 30B comprises a substantially flat upper surface. Adjacent resilient projections 50 within each section 30A and 30B are separated by a trough 51. In other words, the resilient projections 50 may be disposed in spaced relationship relative to each other. Thus, the area of substantially flat upper surfaces 49 for each section 28A, 28B and 28C are greater than the upper surfaces of the resilient projections 50 of each section 30A and 30B. Thus sections 28A, 28B and 28C are firmer or less resilient than sections 30A and 30B.

Figure 11:
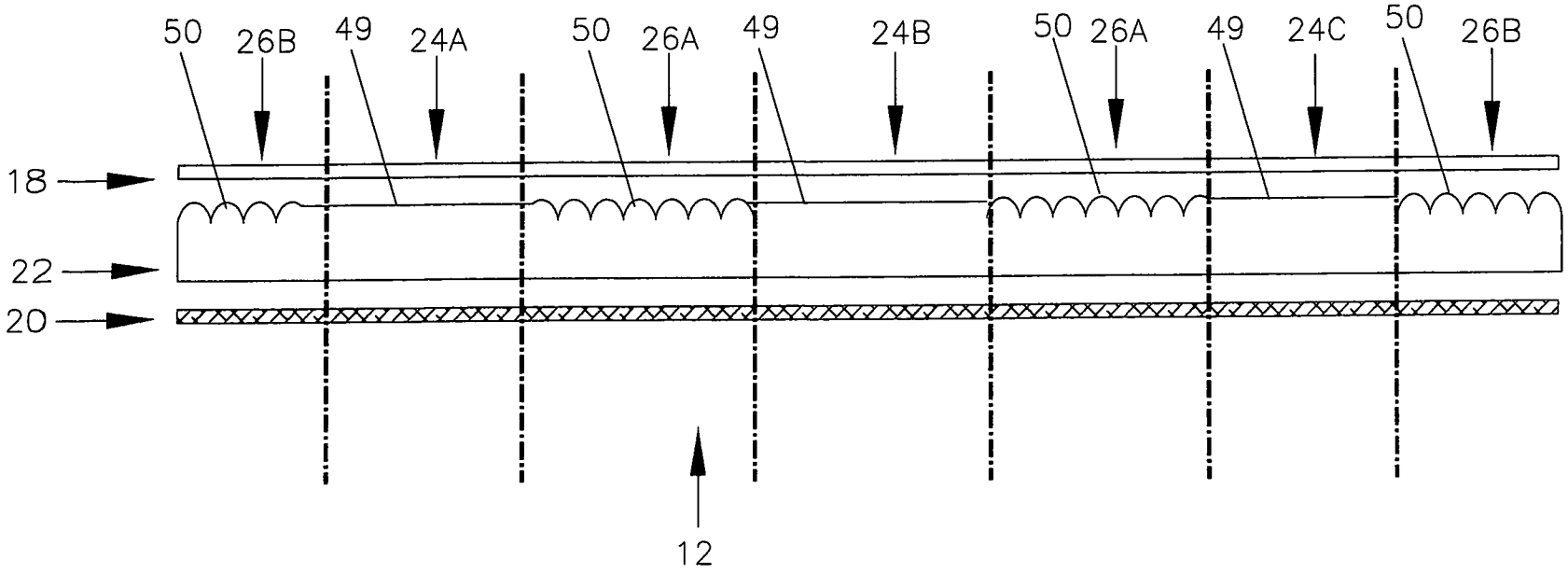
FIG. 11 is an exploded cross-sectional side view of an alternate embodiment of the top layer of the multi-zone mattress of the present invention.

FIG. 11 depicts an alternate embodiment of the quilted top layer 12. Specifically, the quilted top layer 12 comprises an outer upholstery or fabric panel generally indicated as 18 and an inner fabric backing generally indicated as 20 having a block of resilient material generally indicated as 22 such as foam disposed therebetween. The quilted top layer 12 comprises a first plurality of sections including a proximal section generally indicated as 24A, a middle section generally indicated as 24B and a distal section generally indicated as 24C separated by a second plurality of sections including a pair of interior sections each indicated as 26A. In addition, the second plurality of sections may further comprise a pair of exterior sections each indicated as 26B formed on opposite ends of the quilted top layer 12. The substantially flat upper surfaces 49 of the block of resilient material of the first plurality comprising sections 24A, 24B and 24C have a first firmness profile greater than the second firmness profile of the substantially convex projections 50 of sections 26A and 26B of the second plurality of sections to support a person thereon.

Figure 12:
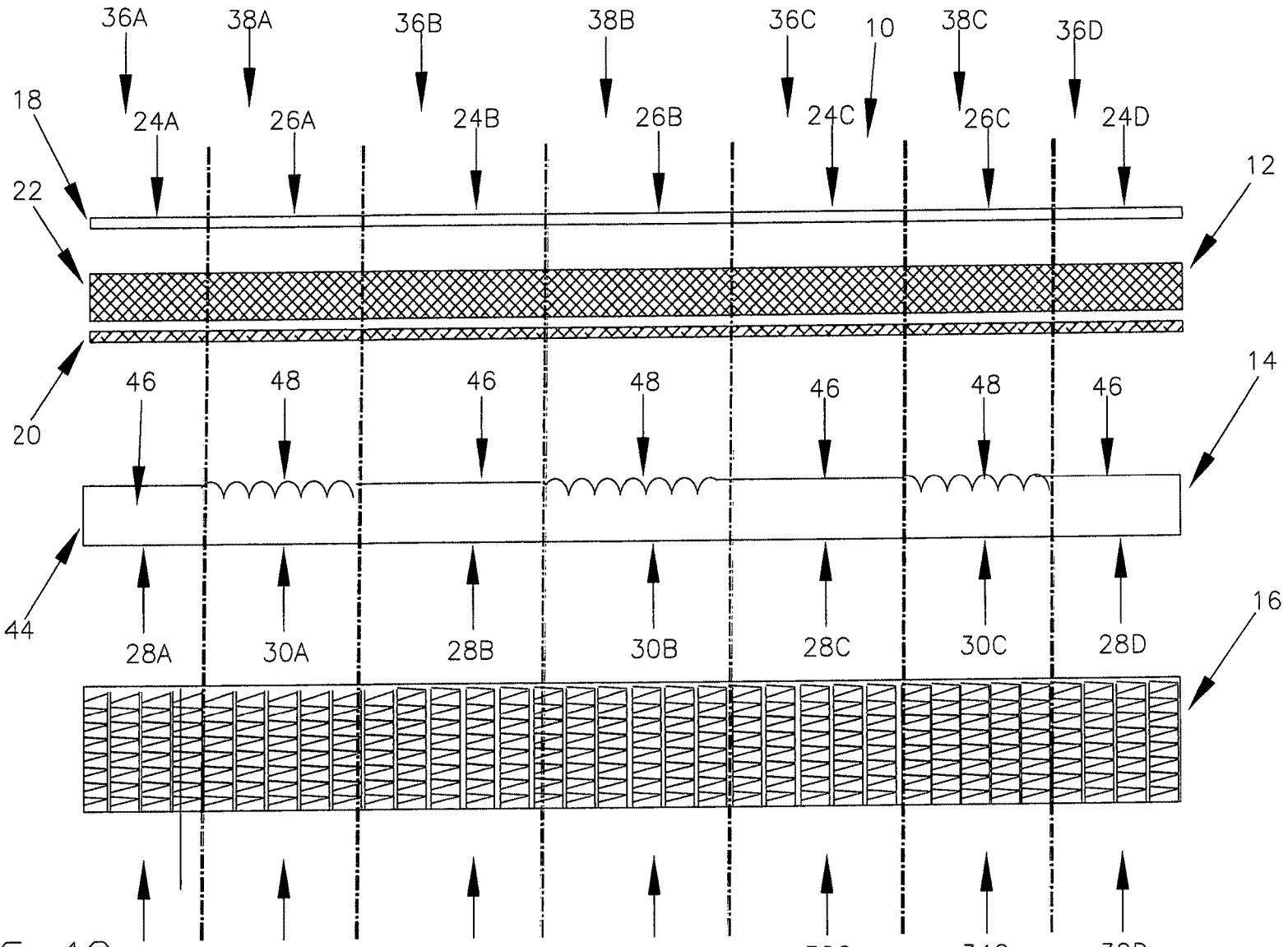
FIG. 12 is an exploded cross-sectional side view of still another alternate embodiment of the multi-zone mattress of the present invention.

FIG. 12 shows an alternate embodiment of the multi-zone mattress 10. Specifically, the top layer 12 comprises a quilted or outer upholstery panel generally indicated as 18 and an inner fabric backing generally indicated as 20 having a panel or block of resilient material generally indicated as 22 such as foam disposed therebetween.

The top layer 14 comprises a first plurality of sections including a proximal exterior section 24A, a proximal interior section 24B, a distal interior section 24C and a distal exterior section 24D and a second plurality of sections including a proximal section 26A, a middle section 26B and a distal section 26C. The first plurality of sections comprising sections 24A, 24B, 24C and 24D has a first firmness profile and the second plurality of sections comprising sections 26A, 26B and 26C has a second firmness profile less than the first firmness profile of the first plurality of sections 24A, 24B, 24C and 24D.

As shown in FIG. 12, the intermediate support layer 14 comprises an intermediate block of resilient material generally indicated as 44 such as foam comprising a first plurality of sections including a proximal exterior section 28A, a proximal interior section 28B, a distal interior section 28C and a distal exterior section 28D and a second plurality of sections including a proximal section 30A, a middle section 30B and a distal section 30C. The first plurality of sections comprising sections 28A, 28B, 28C and 28D has a first firmness profile and the second plurality of sections comprising sections 30A, 30B and 30C has a second firmness profile less than the first firmness profile of the first plurality of sections 28A, 28B, 28C and 28D.

As shown in FIG. 12, the bottom layer 16 comprises a resilient base such as a plurality of coil springs arranged or disposed in rows and columns comprising a first plurality of sections including a proximal exterior section 32A, a proximal interior section 32B, a distal interior section 32C and a distal exterior section 32D and a second plurality of sections including a proximal section 34A, a middle section 34B and a distal section 34C. The first plurality of sections comprising sections 32A, 32B, 32C and 32D has a first firmness profile and the second plurality of sections 34A, 34B and 34C has a second firmness profile less than the first firmness profile of the first plurality of sections 32A, 32B, 32C and 32D.

The top layer 12 of the multi-zone mattress 10 of the alternate embodiment shown in FIG. 12 may comprise any of the embodiments previously described.

The intermediate layer 14 of the multi-zone mattress 10 of the embodiment in FIG. 12 may comprise any of the embodiments previously described.

The bottom layer 16 of the multi-zone mattress 10 of the alternate embodiment shown in FIG. 12 may comprise any of the embodiments previously described.

The first plurality of zones comprises the proximal exterior zone 36A formed by the proximal exterior section 24A of the top layer 12, the proximal exterior section 28A of the intermediate layer 14 and the proximal section 32A of the bottom layer 16; a proximal interior zone 36B formed by the proximal interior section 24B of the top layer 12, the proximal interior section 28B of the intermediate layer 16 and the proximal interior section 32B of the bottom layer 16; a distal interior zone 36C formed by the distal interior section 24C of the top layer 12, the distal interior section 28C of the intermediate layer 14 and the distal interior section 32C of the bottom layer 16 and a distal interior zone 36D formed by the distal exterior section 24D of the top layer 12, the distal exterior section 28D of the intermediate layer 14 and the distal exterior section 32D of the bottom layer 16.

The second plurality of zones comprises a proximal zone 38A comprising the proximal section 26A of the top layer 12, the proximal section 30A of the intermediate layer 14 and the proximal section 34A of the bottom layer 16; a middle zone 38B comprising the middle section 26B of the top layer 12, the middle section 30B of the intermediate layer 14 and the middle section 34B of the bottom layer 16; and a distal zone 38C comprising the distal section 26C of the top layer 12, the distal section 30C of the intermediate layer 14 and the distal section 34C of the bottom layer 16.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A mattress comprising a top layer, an intermediate layer and a bottom layer disposed in substantially parallel relationship relative to each other including a first plurality of zones each having a first firmness profile to support a person thereon separated by a second plurality of zones each having a second firmness profile less than said firmness of said first firmness profile of said first plurality of zones, said first plurality of zones and said second plurality of zones each cooperatively formed by corresponding sections of said top layer, said intermediate layer and said bottom layer disposed in substantially parallel alignment relative to each other wherein said top layer comprises an outer upholstery or fabric panel and an inner fabric backing having a panel of resilient material disposed therebetween, said outer upholstery or fabric panel comprises a first plurality of sections including a proximal section, a middle section and a distal section separated by a second plurality of sections including a pair of interior sections, said first plurality of sections having a first firmness profile to support a person thereon and said second plurality of sections having a second firmness profile less than said first firmness profile of said first plurality of sections.

2. The mattress of claim 1 wherein said intermediate support layer comprises an intermediate panel or block of resilient material.

3. The mattress of claim 2 wherein said bottom foundation layer comprises a foundation resilient base of coil springs arranged or disposed in rows and columns.

4. The mattress of claim 1 wherein said second plurality of sections further comprises a pair of exterior sections formed on each end portion of said top layer of said mattress.

5. The mattress of claim 1 wherein said intermediate support layer comprises a panel or block of resilient material comprising said first plurality of sections including a proximal section, a middle section and a distal section separated by said second plurality of sections including a pair of interior sections, said first plurality of sections having a first firmness profile to support a person thereon and said second plurality of sections of said intermediate support layer having a second firmness profile less than the first firmness profile of said first plurality of sections of said intermediate support layer.

6. The mattress of claim 5 wherein said second plurality of sections of said intermediate support layer further comprises a pair of exterior sections formed on each end portion of said intermediate support layer of said mattress.

7. The mattress of claim 5 wherein said bottom foundation layer comprises a foundation resilient base comprising said first plurality of sections including a proximal section, a middle section and a distal section separated by said second plurality of sections including a pair of interior sections, said plurality of sections having a first firmness profile to support a person thereon and said second plurality of sections of said bottom foundation layer having a second firmness profile less than the first firmness profile of the said first plurality of sections of said bottom foundation layer.

8. The mattress of claim 7 wherein said second plurality of sections of said bottom foundation layer may further comprises a pair of exterior sections formed on each end portion of said bottom foundation layer of said mattress.

9. The mattress of claim 7 wherein said proximal section of said top layer, said proximal section of said intermediate support layer and said proximal section of said bottom foundation layer cooperatively form a proximal support zone; said middle section of said top layer, said middle section of said intermediate support layer and said middle section of said bottom foundation layer cooperatively form a middle support zone and said distal section of said top layer, said distal section of said intermediate support layer and said distal section of said bottom foundation layer cooperatively form a distal support zone to form the said first plurality of zones having a first firmness profile to support a person on the mattress.

10. The mattress of claim 7 wherein corresponding interior sections of said top layer, said intermediate support layer and said bottom foundation layer cooperatively form corresponding second plurality of zones having a firmness profile less than the first firmness profile of said first plurality of zones.

11. The mattress of claim 1 wherein said proximal section, said intermediate section and said distal section of said top layer each comprises a separate panel of fabric having a weight or density greater than the weight or density of said separate panels forming said interior sections.

12. The mattress of claim 1 wherein said top layer comprises a single sheet of fabric having a second sheet of fabric sewn or otherwise held in place on said single sheet of fabric.

13. The mattress of claim 5 wherein said intermediate layer comprises a panel or block having a plurality of resilient projections extending upwardly from the upper surfaces of said interior sections.

14. The mattress of claim 7 wherein said bottom foundation layer comprises a plurality of coil springs arranged in columns, said coil springs of said first plurality of zones in adjacent rows are off-set to form a nested configuration and said plurality of coil springs of said interior sections are symmetrically arranged in rows and columns such that nested configurations are firmer than the symmetrically non-nested configurations to provide more support than the symmetrical non-nested configurations.

15. The mattress of claim 7 wherein said bottom foundation layer of said mattress comprises a plurality of symmetrically arranged coil springs, said coil springs of said proximal section, said middle section and said distal section are less resilient than said coil springs of said interior sections.

16. The mattress of claim 5 wherein said intermediate layer comprises a block of resilient material including a plurality of substantially convex resilient projections extending upwardly from said first plurality of sections and a plurality of substantially convex resilient projections extending upwardly from said second plurality of sections; an upper surface of said substantially convex resilient projections of said first plurality of sections being greater than said upper surfaces of said substantially convex resilient projections of said second plurality of sections.

17. The mattress of claim 16 wherein said a plurality of substantially convex resilient projections extending upwardly from said second plurality of sections are disposed in spaced relationship relative to each other.

18. The mattress of claim 5 wherein upper surfaces of said first plurality of sections of said intermediate layer are substantially flat and a plurality of resilient projections extend upwardly from said upper portions of said interior sections.

19. The mattress of claim 18 wherein adjacent resilient projections within each said interior section is separated by a trough and upper surfaces of said resilient projections are substantially flat.

20. A mattress comprising a top layer, an intermediate layer and a bottom layer disposed in substantially parallel relationship relative to each other including a second plurality of zones each having a first firmness profile to support a person thereon separated by a first plurality of zones each having a second firmness profile less than the firmness of said first firmness profile of said first plurality of zones, said first plurality of zones and said second plurality of zones each cooperatively formed by corresponding sections of said top layer, said intermediate layer and said bottom layer disposed in substantially parallel alignment relative to each other, said top layer comprises an outer upholstery or fabric panel and an inner fabric backing having a panel of resilient material disposed therebetween, said intermediate support layer comprises an intermediate panel or block of resilient material, said outer upholstery or fabric panel comprises a second plurality of sections including a proximal section, a middle section and a distal section separated by a first plurality of sections including a pair of interior sections, said first plurality of sections having a first firmness profile to support a person thereon and said second plurality of sections having a second firmness profile less than said first firmness profile of said first firmness profile of said first plurality of sections, said intermediate support layer comprises a panel or block of resilient material comprising said second plurality of sections including a proximal section, a middle section and a distal section separated by said first plurality of sections including a pair of interior sections, said first plurality of sections having a first firmness profile to support a person thereon and said second plurality of sections of said intermediate support layer having a second firmness profile less than first firmness profile of said first plurality of sections of said intermediate support layer, and said bottom foundation layer comprises a resilient base comprising said second plurality of sections including a proximal section, a middle section and a distal section separated by said first plurality of sections including a pair of interior sections, said plurality of sections having a first firmness profile to support a person thereon and said second plurality of sections of said bottom foundation layer having a second firmness profile less than said first firmness profile of the said first plurality of sections of said bottom foundation layer.

21. The mattress of claim 16 wherein said intermediate layer comprises a block of resilient material including a plurality of substantially convex resilient projections extending upwardly from said first plurality of sections and a plurality of substantially convex resilient projections extending upwardly from said second plurality of sections; an upper surface of said substantially convex resilient projections of said first plurality of sections being greater than said upper surfaces of said substantially convex resilient projections of said second plurality of sections.

22. The mattress of claim 17 wherein said a plurality of substantially convex resilient projections extending upwardly from said second plurality of sections are disposed in spaced relationship relative to each other.

23. The mattress of claim 20 wherein said second plurality of sections of said intermediate support layer further comprises a pair of exterior sections formed on each end portion of said intermediate support layer of said mattress and said bottom foundation layer comprises a foundation resilient base comprising said first plurality of sections including a proximal section, a middle section and a distal section separated by said second plurality of sections including a pair of interior sections, said plurality of sections having a first firmness profile to support a person thereon and said second plurality of sections of said bottom foundation layer having a second firmness profile less than the first firmness profile of the said first plurality of sections of said bottom foundation layer.

24. A mattress comprising a top layer, an intermediate layer and a bottom layer disposed in substantially parallel relationship relative to each other including a first plurality of zones each having a first firmness profile to support a person thereon separated by a second plurality of zones each having a second firmness profile less than the firmness of said first firmness profile of said first plurality of zones, said first plurality of zones and said second plurality of zones each cooperatively formed by corresponding sections of said top layer, said intermediate layer and said bottom layer disposed in substantially parallel alignment relative to each other wherein said top layer comprises an outer upholstery or fabric panel having a first plurality of sections including a proximal section, a middle section and a distal section separated by a second plurality of sections including a pair of interior sections, said first plurality of sections having a first firmness profile to support a person thereon and said second plurality of sections having a second firmness profile less than said first firmness profile of said first plurality of sections.

* * * * *